US006348008B1

(12) United States Patent
Bertoniere, Jr.

(10) Patent No.: US 6,348,008 B1
(45) Date of Patent: Feb. 19, 2002

(54) GOLF BALL TEEING APPARATUS

(75) Inventor: August Bertoniere, Jr., 1717 Carrollton Ave., Metairie, LA (US) 70005

(73) Assignee: August Bertoniere, Jr., Metairie, LA (US)

( * ) Notice: Subject to any disclaimer, the term of this patent is extended or adjusted under 35 U.S.C. 154(b) by 0 days.

(21) Appl. No.: 09/576,698

(22) Filed: May 23, 2000

(51) Int. Cl.[7] ..... A63B 57/00
(52) U.S. Cl. ..... 473/132; 473/134; 473/386
(58) Field of Search ..... 473/132, 133, 473/134, 137

(56) References Cited

U.S. PATENT DOCUMENTS 4,177,996 A * 12/1979 Chang
5,665,004 A * 9/1997 Vlahovie
5,704,844 A * 1/1998 Luther
D391,332 S * 2/1998 Williams
6,179,719 B1 * 1/2001 Hwang

* cited by examiner

*Primary Examiner*—Jeanette Chapman
*Assistant Examiner*—Nini F. Legesse

(57) ABSTRACT

A device for storing golf balls and dispensing them onto a bed of bristles that serves as a golf tee.

2 Claims, 7 Drawing Sheets

GOLF BALL TEEING APPARATUS

Background of the Invention

This invention relates to an automatic golf ball-teeing device.

DESCRIPTION OF PRIOR ART

After an extensive search of available prior art, it has become apparent that other forms of golf ball teeing device operate differently. For instance, U.S. Pat. No. 5,016,886 to Bobby Gould on May 21, 1991 utilizes a bucket and a complicated in ground mechanism. U.S. Pat. No. 4,177,996 to Tommy Chang on Dec. 11, 1979 utilizes a bucket and a placement rod to place a ball on to a tee.

U.S. Pat. No. 4,732,391 to Robert Karr on Mar. 22, 1988 utilizes yet another configuration of a placement arm to get the ball to the tee.

Jamming of the balls proved to be a problem that inventors had to deal with: U.S. Pat. No. 5,624,325 to Michael Smith Apr. 29, 1997 also utilizes a pivoting channel arm to roll a ball to a tee. This device has anti jamming rods connected to the arm to agitate the balls. U.S. Pat. No. 5,464,223 to John Demont Mar. 28, 1994 uses guides and blockers to keep the balls from jamming. Others use powered agitators to keep balls from jamming, which are noisy and distracting.

OBJECTS AND ADVANTAGE

To provide a golf ball-teeing device which is superior to all others.

To provide a golf ball-teeing device which is portable.

To provide a golf ball-teeing device, which does not require any parts, that has to be underground.

To provide a golf ball-teeing device which has aesthetic appeal.

To provide a golf ball-teeing device which is affordable.

To provide a golf ball teeing device that is light weight.

To provide a golf ball-teeing device which is tough.

To provide a golf ball-teeing device which does not jam.

To provide a golf ball-teeing device that is spring and gravity powered.

To provide a golf ball-teeing device which has its mechanism in a protective housing.

SUMMARY OF THE INVENTION

In accordance with the present invention, a golf ball teeing apparatus comprises a bucket, spiraled tube, control chamber, control member, lever, base, clearance holes, lift member, consistency member, exit chamber, hinge, spring, speed/angle adjustment member that comprises a first portion, a second portion that is a threaded rod and a third portion that is a screw bolt, bristle tee mat and a channel path in the bristles.

DRAWING FIGURES

| | |
|---|---|
| 10 bucket | 12 spiraled tube |
| 14 base | 16 control chamber |
| 18 clearance hole | 20 control member |
| 22 lift member | 24 consistency member |
| 26 exit chamber | 28 hinge |
| 30 angle/speed adjustment member | 36 spring |
| 34 lever | 40 tee base |
| 38 adjustment rod | 44 channel |
| 42 bristles | 48 mat |
| 46 wall | 50 rotating rod of 30 |
| 51 first portion of 30 | 52 third portion of 30/screw bolt |
| 53 ball loading end | 54 ball dispensing end |

DETAILED DESCRIPTION OF THE DRAWINGS

Figure 1:
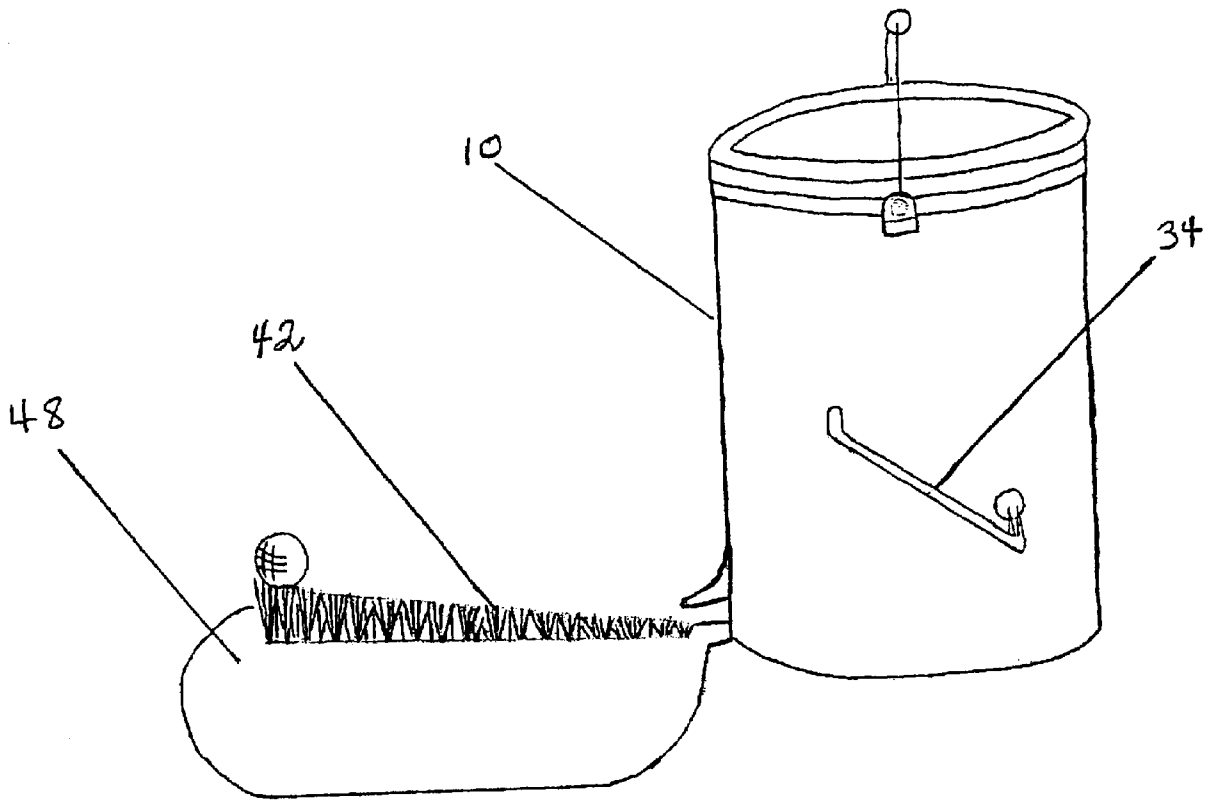
FIG. 1 shows the view of the apparatus with the tee mat extended
Figure 2:
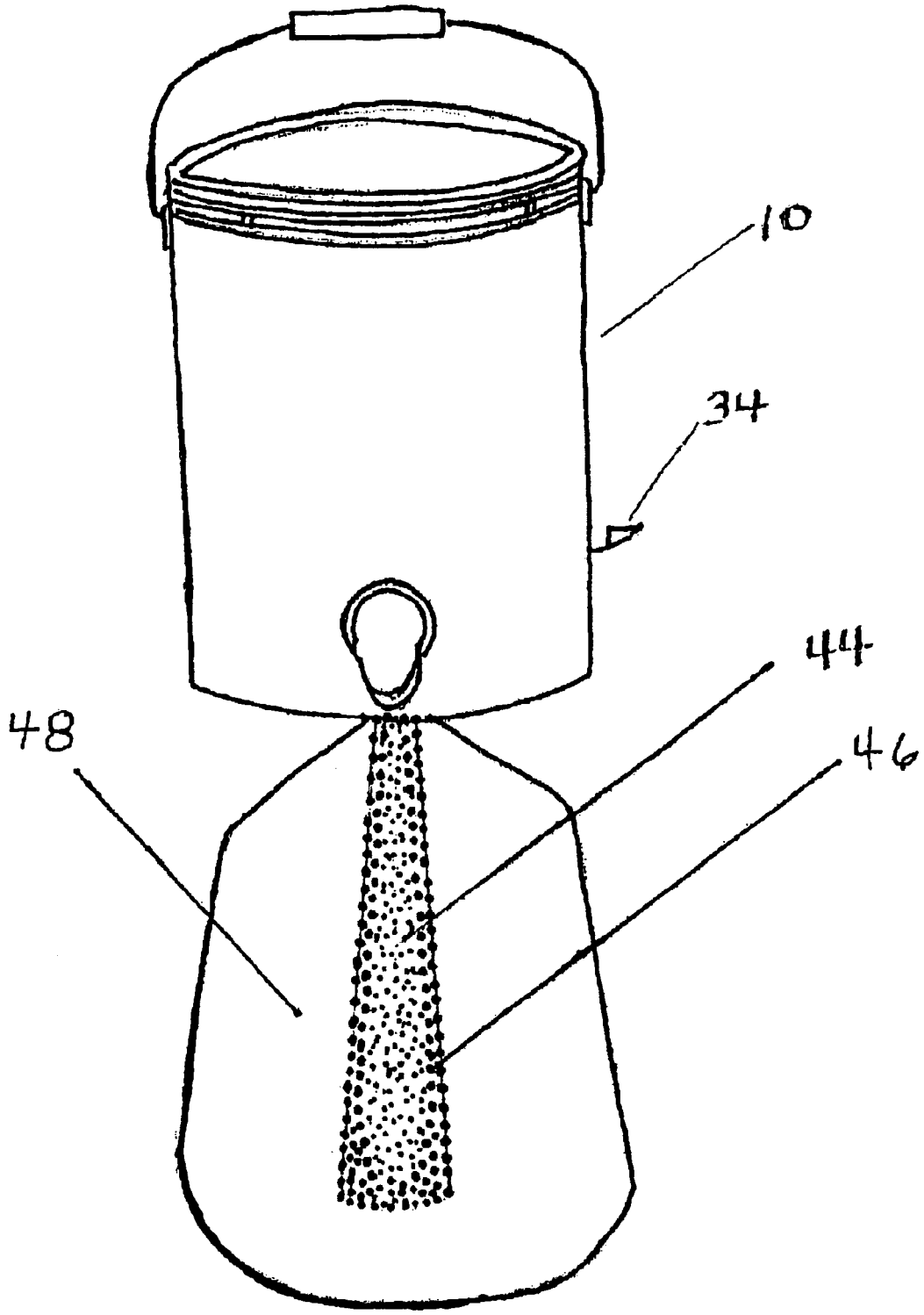
FIG. 2 shows a front exterior view of the bucket with the mat extended
Figure 3:
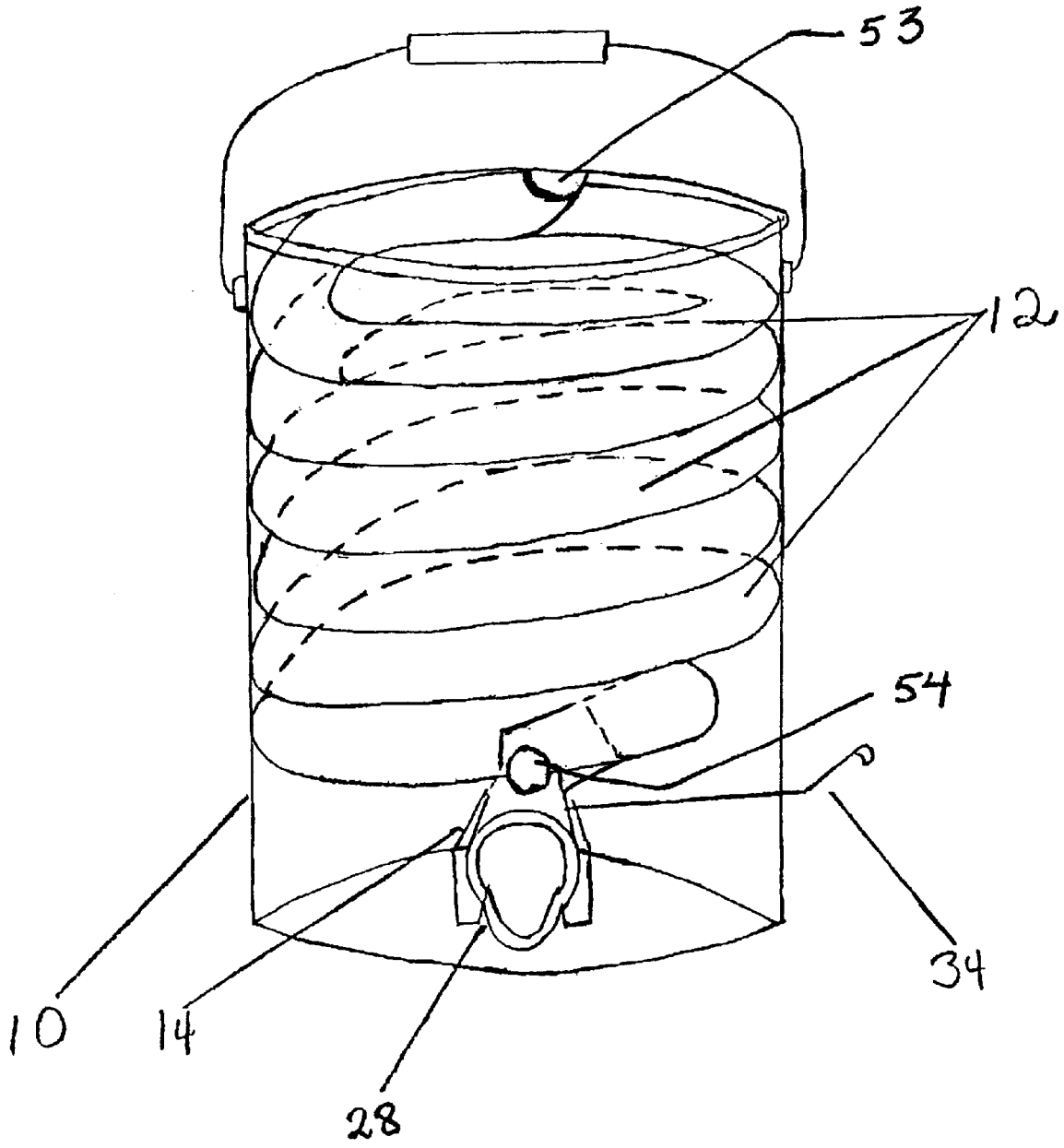
FIG. 3 shows an interior view of the device
Figure 4:
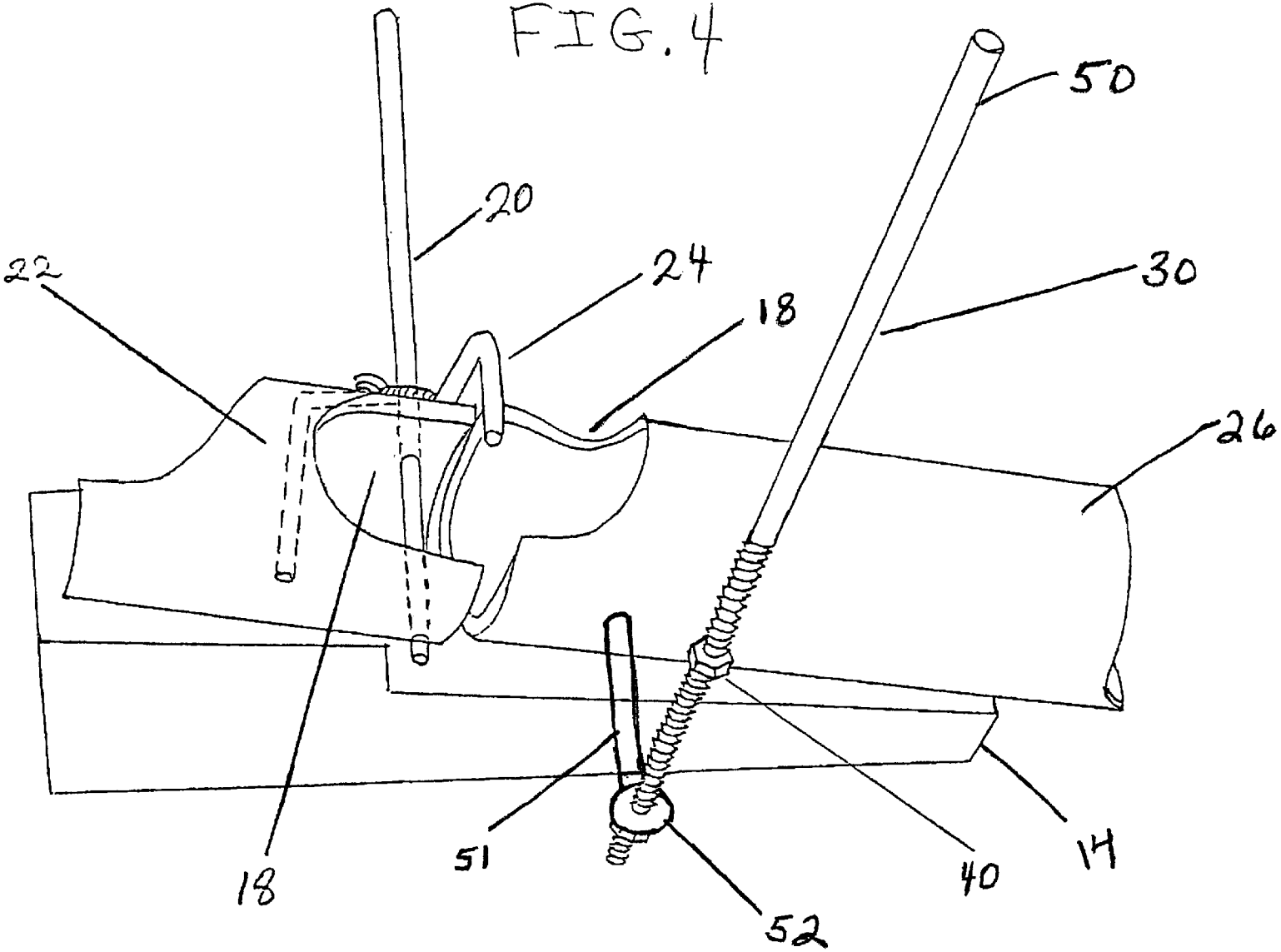
FIG. 4 shows the internal control chamber
Figure 5:
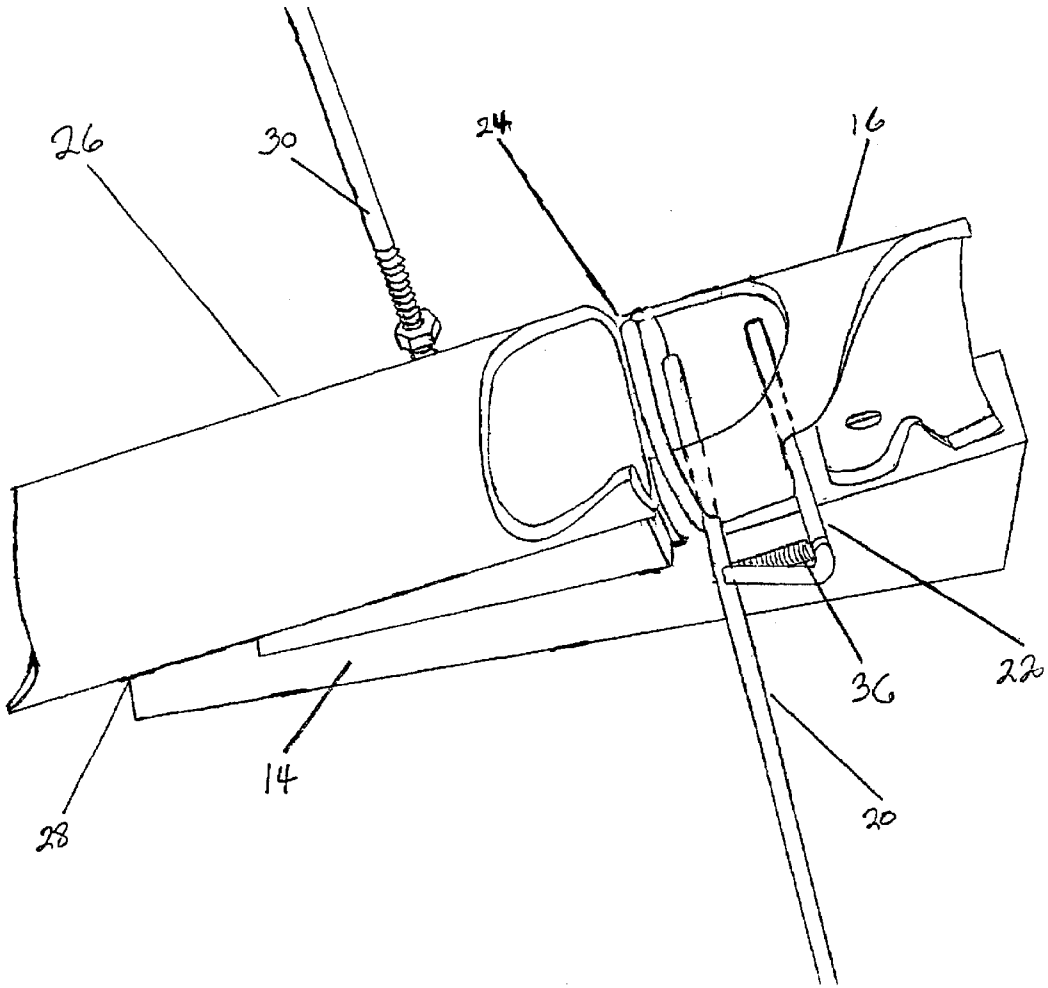
FIG. 5 shows the internal control chamber with control member in a first position.
Figure 6:
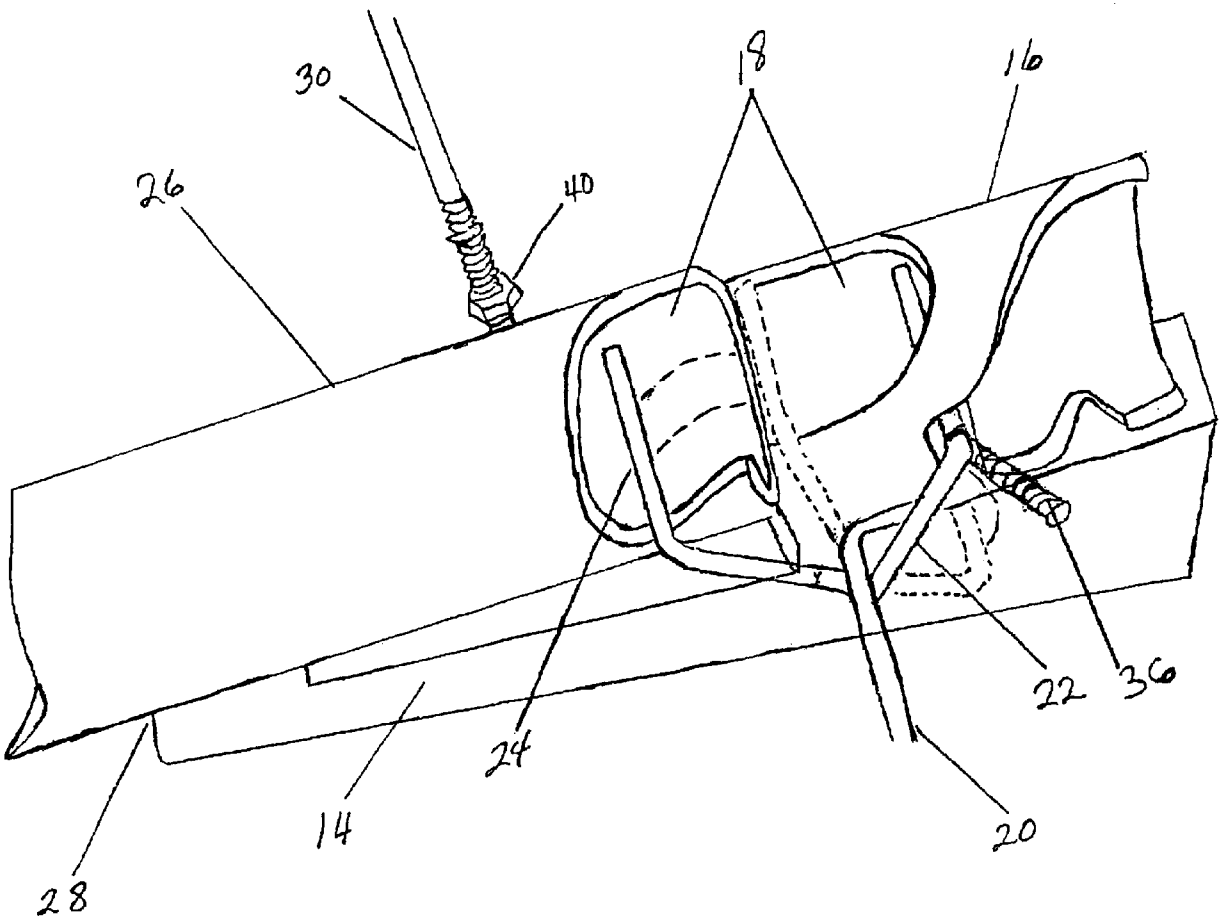
FIG. 6 shows the internal control chamber top view with control member in second position with first position with first position denoted by broken lines
Figure 7:
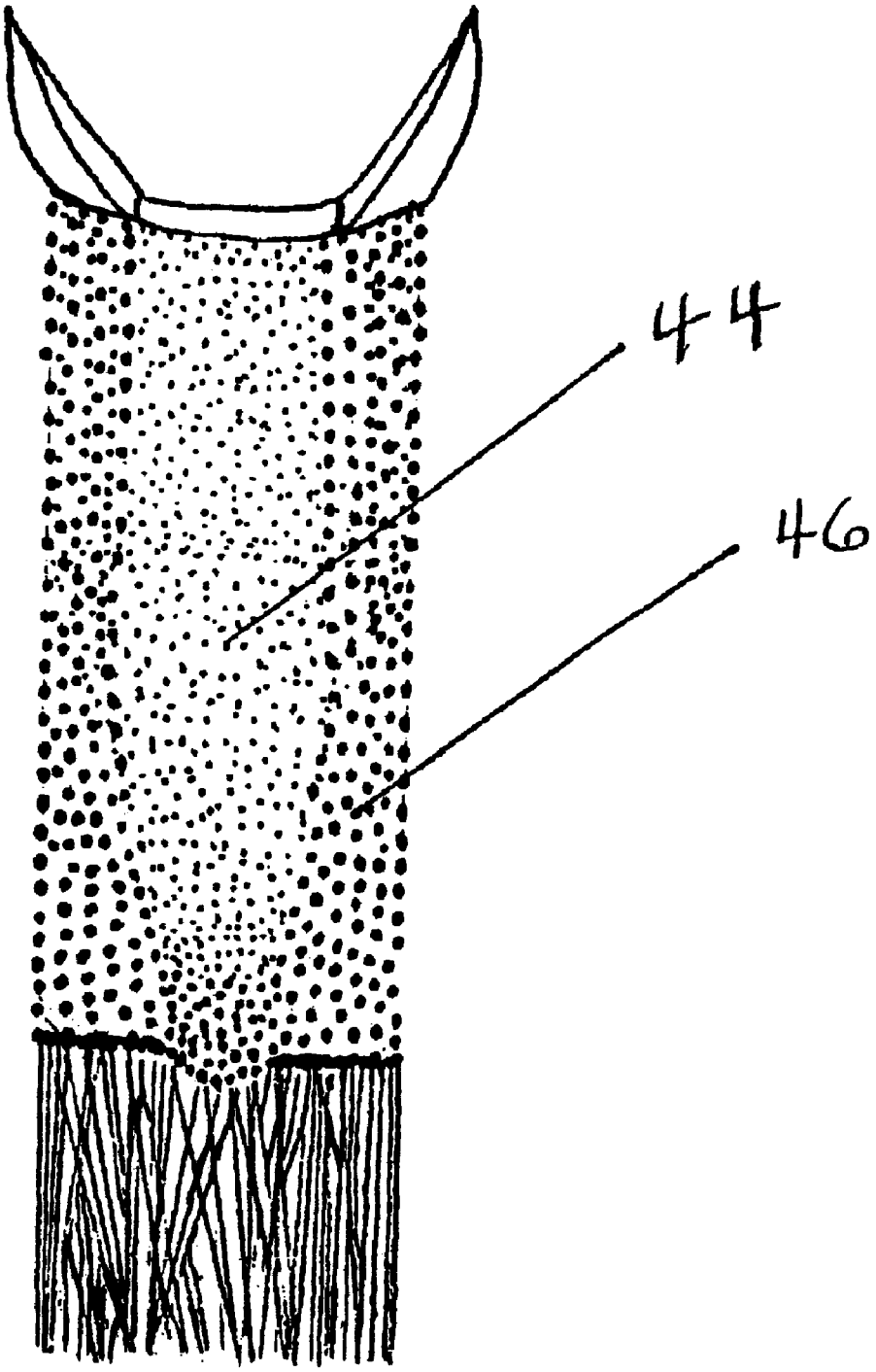
FIG. 7 shows the bristle tee

A typical embodiment of the golf ball teeing apparatus of the present invention is illustrated in the drawing figures. FIG. 1 shows a common bucket 10. A spiraled tube 12 situated in the bucket and is capable of holding a plurality of balls. The spiraled tube 12 is connected communicatively to the control chamber 16. The spiraled tube 12 is usually two inches in diameter and long enough to hold many balls. The control chamber 16 is mounted on a base 14, and base 14 is connected to the inside bottom of the bucket 10.

Control chamber 16 and exit chamber 26 are in line, such that a ball can be moved from control chamber 16 into exit chamber 26. A control member 20 runs perpendicularly through the control chamber 16 and continues to the bucket 10 through a hole in the side of the bucket. A lever 34 is the angular extension of control member 20. By depressing lever 34 one rotates control member 20. A lift member 22 and a consistency member 24 are connected to control member 20. The lift member and control member 20 have a predetermined space between them that is roughly equivalent to two-thirds the diameter of a golf ball, suitable for lifting such a ball. The consistency member 24 is also fastened to the control member 20, and between them is a space just bigger than a golf ball, such that consistency member 24 is able to temporarily catch and stop a ball.

A clearance hole is located directly above the control member 20 in both the control chamber and in the exit chambers. These clearance holes 18 are necessary to allow lift member 22 to carry a ball over control member 20, and also for the consistency member 24 to protrude into exit chamber 26. The exit chamber 26 is attached to base 14 by means of a hinge 28. An angle/speed adjustment member 30 comprises: a threaded rod 30 extending through female threads of bolt screw 52. As shown in FIGS. 4–7 Angle/Speed Adjustment member comprises, a first portion 51 connected to exit member, a second portion 50 is a threaded rod and the third portion 52 is a screw bolt that connects the first and the second portions of the angle/speed adjustment member. Rod 50 is rotatably attached to 52; wherein when rod 50 is rotated, the exit member 26 is moved up or down depending on a direction of rotation.

A spring 36 is used for delivering return tension to the control member 20 to bring control member 20 back to it's initial position.

A tee made of bristles, or a bristle tee is connected to the front of the bucket 10. This bristle tee is made of bristles, which canal be the same in diameter, but have different lengths to form a channel that runs lengthwise away from the bucket.

When the speed/angle adjustment member 30 is rotated the angle of the exit member 26 increases to increase ball speed and decreases to decrease ball speed so as to tune the ball speed as needed to make the ball stop at the end of the channel on the bristle tee.

Using this golf ball teeing apparatus is easy. One loads a plurality of balls into the loading end 53 of the spiraled tube 12. Then, one depresses the lever 34 that rotates control member 20, which sends a ball rolling out of the exit chamber 26 onto the bristle tee. The ball proceeds to the end of the tee where it is ready to be struck by a golf club. Then one hits the ball off of the tee. After that, one depresses the lever 34 again to repeat the process until the plurality of balls is empty.

The process at work is thus: after a ball is loaded through the ball-loading end 53, it proceeds down and around the spiraled tube 12 dispensing end 54 to the control chamber 16. As each ball enters the control chamber 16, it rolls over the lift member 22. A spring 36 holds control member 20 in first position all the time except when the golfer activates or rather rotates the control member 20 by depressing it.

When the golfer depresses the control member 20 it rotates and lift member 22 cradles the ball between itself and control member 20 carrying the ball over up and over control member 20. A consistency member 24 then temporarily stops the ball. Then as the spring 36 returns control member 20 to it's original position, consistency member 24 is lifted and a ball is allowed to proceed down the slope of the exit chamber 26. Then ball rolls into the channel 44 to the end of bristles, which extends outside past bucket 10 for about a foot. Channel 44 is formed by bristles in it being shorter from top to bottom lengthwise than wall bristles 46.

Since the ball starts rolling from a dead stop, the same speed is achieved consecutively. If more or less speed is needed to get a ball to roll all the way to the end of the bristled tee, the user can turn the angle/speed adjustment member 30. By turning angle/speed adjustment member 30 one way or the other, the slope of the exit chamber 26 increases or decreases and this adjustment in turn speeds a ball up or slows a ball down respectively.

From the description above, a number of advantages of my golf ball teeing apparatus become evident:

(a) The use of a bucket as a housing makes for a very durable apparatus (b) Holding balls in a tube makes my apparatus spill proof (c) The precision adjustable speed control of my apparatus affords one with the ability to set the perfect speed to made the ball land on the end of the bristle tee every time.

(d) Having only three moving parts makes my apparatus very reliable.

(e) No packaging is needed for shipping or retailing, only a label affixed to the outside of the bucket is all that is necessary.

(f) The apparatus will take the work out of practicing your game.

(g) The bristle tee and the lever can be placed in the bucket for retail sales and storage, therefore providing for neat stacking on shelves.

(h) No power source is needed for shaking a hopper or operating the mechanism of my apparatus.

It is clearly shown that the current invention can be used to tee up golf balls with very little effort and this apparatus saves the practicing golfer from a lot of back bending. In addition, the golf ball teeing apparatus has further advantages in that:

It is affordable

It utilizes a container that consumers are already familiar with

It is lightweight

It is carried easily

While the present invention has been described above with reference to specific embodiments thereof, it goes without saying that the present invention is not limited to the foregoing embodiments and a variety of modifications and alterations may be made thereto by those skilled in the art without departing from the spirit and scope of the invention. For example, the container could come in different sizes, colors and shapes; the tee can be modified to different lengths, widths and heights and so on. Since obvious changes as mentioned above may be made in the specific embodiments of the invention described herein, such modifications being within the spirit and scope of the invention claimed, it is indicated that all matter contained herein is intended as illustrative and not as limiting in scope.

I claim:

1. An automatic golf ball teeing apparatus comprising:

a bucket (10);

a declining spiraled tube member (12), that is about two inches in diameter positioned in the bucket, wherein said declining spiraled tube having a ball loading end (53) and a ball dispensing end (54), an internal control mechanism comprising a control member (20), a lift member (22), a control chamber (16), a consistency member (24), a base (14), an exit member (26), a spring (36) and a lever (34); wherein said control chamber is mounted on the base that is connected to the inside bottom of the bucket; said control chamber and exit member are in line in such a way that a ball can be moved from control chamber into the exit member; wherein said control member runs perpendicularly through the control chamber, and continues to the outside of the bucket through a hole in the side of the bucket; said lever is an angular extension of the control member and depressing said lever will rotate the control member; said lift member and said consistency member are connected to said control member; said lift and control members have a space between them which is about two-thirds the diameter of a golf ball allowing the lifting of a ball; said consistency and said control members have a space between them just bigger than a golf ball so that said consistency member is able to temporarily catch and stop the ball; said control chamber and the exit chamber each has a clearance hole at their top portion that allows said lift member to carry a ball over said control member then be stopped temporarily by consistency member, said spring returns the control member to an original position, said consistency member (24) is lifted and the ball is allowed to proceed down a slope of the exit member; said control member is returned to its original position by means of said spring and said exit member is attached to said base by means of a hinge(28);

an angle/speed adjustment member comprising three portions; first portion (51) of said member is connected to said exit member, a second portion (50) of said speed adjustment is a rotatable threaded rod and the third portion (52) is a screw bolt that connects the first and the second portions of the angle/speed adjustment member; said rod (50) is rotatably attached to (52); wherein when rod (50) is rotated, the exit member (26) is moved up or down depending on a direction of rotation; and a tee mat (48).

2. The golf ball teeing apparatus of claim 1 wherein: said tee mat (48) is made of bristles of flexible material and includes a channel (44) formed by bristles of a shorter length than a wall of surrounding other bristles.

* * * * *